US008230691B2

(12) United States Patent
Kurihara et al.

(10) Patent No.: US 8,230,691 B2
(45) Date of Patent: Jul. 31, 2012

(54) AIR CONDITIONER AND AIR CONDITIONER CLEANING METHOD

(75) Inventors: Toshiyuki Kurihara, Sakai (JP); Hiromune Matsuoka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 357 days.

(21) Appl. No.: 12/376,172

(22) PCT Filed: Aug. 3, 2007

(86) PCT No.: PCT/JP2007/065234

§ 371 (c)(1),
(2), (4) Date: Feb. 3, 2009

(87) PCT Pub. No.: WO2008/018373

PCT Pub. Date: Feb. 14, 2008

(65) Prior Publication Data

US 2009/0320502 A1 Dec. 31, 2009

(30) Foreign Application Priority Data

Aug. 8, 2006 (JP) ..... 2006-215238

(51) Int. Cl.

| | |
|---|---|
| ***F25B 45/00*** | (2006.01) |
| ***F25B 47/00*** | (2006.01) |
| ***F24F 3/16*** | (2006.01) |
| ***B08B 3/00*** | (2006.01) |
| ***B08B 5/00*** | (2006.01) |

(52) U.S. Cl. ..... 62/77; 62/78; 62/85; 62/149; 137/15.04

(58) Field of Classification Search ..... 62/77, 78, 62/85, 149; 137/15.04, 139, 140

See application file for complete search history.

(56) References Cited

U.S. PATENT DOCUMENTS

| | | | | |
|---|---|---|---|---|
| 4,345,468 | A * | 8/1982 | Jackson | 73/326 |
| 5,307,643 | A * | 5/1994 | Beckerman | 62/77 |
| 6,141,976 | A * | 11/2000 | Numoto et al. | 62/129 |
| 6,357,240 | B1 * | 3/2002 | Zugibe et al. | 62/85 |
| 6,425,252 | B1 * | 7/2002 | Kobayashi et al. | 62/77 |
| 2005/0279126 | A1 * | 12/2005 | Otake et al. | 62/498 |

FOREIGN PATENT DOCUMENTS

| | | |
|---|---|---|
| CN | 1247599 A | 3/2000 |
| JP | 04-198676 A | 7/1992 |

(Continued)

OTHER PUBLICATIONS

Chinese Office Action of corresponding Chinese Application No. 200780029380 dated Feb. 12, 2010.

(Continued)

*Primary Examiner* — Frantz Jules
*Assistant Examiner* — Daniel C Comings
(74) *Attorney, Agent, or Firm* — Global IP Counselors

(57) ABSTRACT

A method of cleaning an air conditioner utilizing carbon dioxide as a working refrigerant includes three steps. In a charging step, a refrigeration cycle is charged with carbon dioxide. In a venting step, a charging target with which the refrigeration cycle is charged is vented after the charging step. In a repeating step a unit operation is performed at least one time or more. The unit operation includes the charging step and the venting step. An air conditioner includes a refrigeration cycle configured to perform the unit operation at least one time, and a counter configured to count and output the number of times that the unit operation has been performed.

19 Claims, 5 Drawing Sheets

FOREIGN PATENT DOCUMENTS

| | | | |
|---|---|---|---|
| JP | 6-18129 | A | 1/1994 |
| JP | 07-083545 | A | 3/1995 |
| JP | 2001-041613 | A | 2/2001 |
| JP | 2001-165535 | A | 6/2001 |
| JP | 2002-357377 | A | 12/2002 |
| JP | 2004-218972 | A | 8/2004 |
| JP | 2004-270974 | A | 9/2004 |
| KR | 20-0157025 | Y1 | 9/1999 |

OTHER PUBLICATIONS

Korean Office Action of corresponding Korean Patent Application No. 10-2009-7003435 dated Feb. 1, 2011.

* cited by examiner

CHARGING AND VENTING OPERATION PRESSURE AND NECESSARY NUMBER OF TIMES OF REPETITION (DIFFERENTIATED BY NITROGEN CONCENTRATION)

| CHARGING PRESSURE (atm) | VOLUME FRACTION OF NITROGEN | | |
|---|---|---|---|
| | 100ppm | 10ppm | 1ppm |
| 1.6 | 20 TIMES | 25 TIMES | 30 TIMES |
| 2 | 14 TIMES | 11 TIMES | 17 TIMES |
| 4 | 7 TIMES | 9 TIMES | 10 TIMES |
| 10 | 4 TIMES | 5 TIMES | 6 TIMES |

FIG. 5

AIR CONDITIONER AND AIR CONDITIONER CLEANING METHOD

CROSS-REFERENCE TO RELATED APPLICATIONS

This U.S. National stage application claims priority under 35 U.S.C. §119(a) to Japanese Patent Application No. 2006-215238, filed in Japan on Aug. 8, 2006, the entire contents of which are hereby incorporated herein by reference.

TECHNICAL FIELD

The present invention relates to an air conditioner and an air conditioner cleaning method and particularly to an air conditioner and an air conditioner cleaning method where carbon dioxide is utilized as a working refrigerant.

BACKGROUND ART

Conventionally, chlorofluorocarbons, which are fluids that hold and efficiently carry thermal energy, has been used as refrigerants used in refrigeration cycles. However, following the adoption of the Montreal Protocol in 1987, the use of these chlorofluorocarbons has begun to be curtailed, and artificially developed substitute chlorofluorocarbons, whose ozone depletion potential is low, are coming to be used as refrigerants.

For example, in Japanese Patent Publication No. 2004-218972, there is proposed, as a method that employs a substitute chlorofluorocarbon to update conventional air conditioning equipment, a method of removing iron chloride that is mixed into a refrigerant as an impurity. Here, there is proposed a method where a conventional CFC refrigerant or HCFC refrigerant is recovered by vacuuming, a relatively eco-friendly HFC refrigerant is introduced to a refrigeration cycle, the HFC refrigerant is recovered and passed through activated carbon in order to adsorb and remove the iron chloride, and thereafter the HFC refrigerant is reintroduced to the refrigeration cycle.

However, following the further adoption of the Kyoto Protocol in 1997, the use of these substitute chlorofluorocarbons also, whose global warming potential is relatively high, is being limited; in 2001, the Chlorofluorocarbon Recovery and Destruction Law, which requires that chlorofluorocarbons be properly recovered when devices are disposed of, was issued, and the development of new substitute refrigerants and technologies that utilize those new substitute refrigerants are attracting attention.

Additionally, as these substitute refrigerants, there are natural refrigerants such as carbon dioxide, ammonia, hydrocarbons (isobutene, propane, etc.), water, and air. These natural refrigerants are materials that have the property that, when compared with the aforementioned chlorofluorocarbons and substitute chlorofluorocarbons, their GWP (Global Warming Potential) value is extremely low.

Among these, carbon dioxide is known as a material whose ozone depletion potential is zero, whose global warming potential is also much lower in comparison to conventional refrigerants, which has no toxicity, is nonflammable, and whose efficiency in creating a high temperature is good among natural refrigerants, and from environmental/energy aspects and safety aspects, carbon dioxide is garnering attention as a refrigerant in air conditioners.

SUMMARY OF THE INVENTION

Problem that the Invention is to Solve

However, in the method described in aforementioned Japanese Patent Publication No. 2004-218972, when the refrigerant with which the refrigeration cycle had been charged is to be recovered, processing to depressurize the refrigeration cycle and perform vacuuming becomes essential.

Further, when a split type air conditioner is constructed on site, an air tightness test using nitrogen or the like is performed in order to check whether or not working refrigerant will circulate through the refrigeration cycle without leaking, and in this case, it is necessary to remove the nitrogen inside the refrigeration cycle after the air tightness test has ended. Further, it is also necessary to remove air because any component other than the working refrigerant ends up becoming an impurity. In this case also, processing to depressurize the refrigeration cycle and perform vacuuming becomes essential.

For this reason, in order to perform vacuuming, an operation for vacuuming and a device for vacuuming end up becoming separately necessary.

The present invention has been made in view of the aforementioned point, and it is an object of the present invention to provide an air conditioner and an air conditioner cleaning method which, when using carbon dioxide as a working refrigerant, are capable of reducing the quantity of impurities remaining in a refrigeration cycle while using existing equipment and without having to perform vacuuming.

Means for Solving the Problem

An air conditioner cleaning method pertaining to a first aspect of the present invention is a method of cleaning an air conditioner where carbon dioxide is utilized as a working refrigerant, and the method is disposed with the following steps. In a charging step, a refrigeration cycle is charged with a working fluid. In a venting step a charging target with which the refrigeration cycle is charged is vented after the charging step. In a repeating step, when the charging step and the venting step configure a unit operation, the unit operation is repeated at least one time. It will be noted that it is not particularly necessary for the working fluid for cleaning here to have a function as a refrigerant during air conditioning, and carbon dioxide and nitrogen or the like are included.

Here, the refrigeration cycle is charged with the working fluid in the charging step, whereby the relative concentration of impurities inside the refrigeration cycle can be reduced. Additionally, in the venting step, the charging target including impurities with which the refrigeration cycle is charged is vented to the outside of the refrigeration cycle without having to perform conventional vacuuming of the refrigeration cycle. At this time, some of the impurities that had been present inside the refrigeration cycle are also vented to the outside of the refrigeration cycle, and the absolute quantity of impurities inside the refrigeration cycle is reduced. Additionally, in the repeating step, the unit operation resulting from the charging step and the venting step is repeated at least one time.

Thus, the quantity of impurities inside an existing refrigeration cycle that is charged with carbon dioxide as a working refrigerant can be reduced without having to perform vacuuming.

An air conditioner cleaning method pertaining to a second aspect of the present invention comprises the air conditioner cleaning method pertaining to the first aspect of the present invention, wherein in the charging step, charging of the refrigeration cycle with the working fluid is performed until the pressure inside the refrigeration cycle becomes a pressure that at least exceeds atmospheric pressure. In the venting step, venting of the charging target is performed until the pressure inside the refrigeration cycle becomes substantially atmospheric pressure. The pressure that is equal to or greater than atmospheric pressure in the charging step here is preferably equal to or greater than 5 atm and more preferably equal to or greater than 7 atm.

Here, the refrigeration cycle continues to be charged with the working fluid until the pressure inside the refrigeration cycle becomes a pressure that exceeds atmospheric pressure, so the concentration of impurities remaining inside the refrigeration cycle can be reduced even more. Additionally, after the charging step that reduces the relative concentration of impurities in this manner has ended, in the venting step, venting of the charging target is performed until the pressure inside the refrigeration cycle becomes substantially atmospheric pressure, and in accompaniment with the venting of a large quantity of the working fluid, it becomes possible to vent a large quantity of impurities to the outside of the refrigeration cycle.

Thus, it becomes possible to more efficiently reduce impurities inside the refrigeration cycle.

It will be noted that, when the above air conditioner cleaning method is executed in, for example, a refrigeration cycle where plural indoor units are connected by communication pipes with respect to one outdoor unit, a cleaning effect that is higher than conventional vacuuming is obtained in portions where the refrigerant pipes branch in order to connect to the plural indoor units. That is, in vacuuming, which has conventionally been performed, there is the potential for the cleaning effect to improve only at the portions of the pipes where it is easy for a fluid to flow, and there are cases where one wishes to improve the cleaning effect at the branching portions of the pipes or the like. With respect thereto, here, the refrigeration cycle is charged with the working fluid until the pressure inside the refrigeration cycle becomes equal to or greater than atmospheric pressure, so it becomes possible for impurities that are present in portions where it is difficult for a fluid to flow, such as in branching portions of pipes, to mix together with the working fluid, blend into the working fluid, and be efficiently vented.

An air conditioner cleaning method pertaining to a third aspect of the present invention comprises the air conditioner cleaning method pertaining to the first aspect of the present invention or the second aspect of the present invention, wherein the working fluid is carbon dioxide of the same component as the working refrigerant.

Here, carbon dioxide, which is the same component as the working refrigerant, is used as the working fluid that is used in order to clean the inside of the refrigeration cycle. For this reason, even if the working fluid with which the inside of the refrigeration cycle has been charged in the charging step remains after the venting step, the working fluid eventually becomes utilized as the working refrigerant, so there is no problem.

Thus, it becomes possible to avoid a situation where the working fluid for cleaning the inside of the refrigeration cycle ends up remaining inside the refrigeration cycle after the venting step, and the cleaning effect can be raised.

It will be noted that, when the above air conditioner cleaning method is executed in, for example, a refrigeration cycle where plural indoor units are connected by communication pipes with respect to one outdoor unit, a cleaning effect that is higher than conventional vacuuming is obtained in portions where the refrigerant pipes branch in order to connect to the plural indoor units. That is, in vacuuming, which has conventionally been performed, there is the potential for the cleaning effect to improve only at the portions of the pipes where it is easy for a fluid to flow, and there are cases where one wishes to improve the cleaning effect at the branching portions of the pipes or the like. With respect thereto, here, the refrigeration cycle is charged with the working fluid until the pressure inside the refrigeration cycle becomes equal to or greater than atmospheric pressure, so it becomes possible for impurities that are present in portions where it is difficult for a fluid to flow, such as in branching portions of pipes, to mix together with the working fluid, blend into the working fluid, and be efficiently vented.

An air conditioner cleaning method pertaining to a fourth aspect of the present invention comprises the air conditioner cleaning method pertaining to the first aspect of the present invention or the second aspect of the present invention, wherein the working fluid is nitrogen.

Here, nitrogen, which is different from the working fluid that is utilized during air conditioning operation, is used as the working fluid for cleaning. Nitrogen has poor chemical reactivity with respect to impurities or the like inside the pipes, so a cleaning effect that corresponds to the quantity of nitrogen with which the refrigeration cycle is charged can be obtained. Additionally, it suffices for the refrigeration cycle to be charged with the carbon dioxide that is utilized as the working refrigerant while the charging target is recovered from the refrigeration cycle that is charged with the nitrogen.

Thus, it becomes possible to reduce the quantity of the carbon dioxide that is vented when cleaning the refrigeration cycle.

Further, nitrogen is inactive, so a situation where the nitrogen chemically reacts with impurities and ends up eroding the walls of the pipes can be avoided.

An air conditioner cleaning method pertaining to a fifth aspect of the present invention comprises the air conditioner cleaning method pertaining to any of the first aspect of the present invention to the fourth aspect of the present invention, wherein a relationship between the number of times that the unit operation is repeated in the repeating step and at least one value of the temperature of the working fluid with which the refrigeration cycle is charged in the charging step and the pressure inside the refrigeration cycle when stopping charging in the charging step is in a substantially inversely proportional relationship.

Here, when the temperature of the working fluid with which the refrigeration cycle is charged in the charging step and/or the pressure inside the refrigeration cycle when stopping charging in the charging step are/is to be raised, it suffices for the number of times that the unit operation is repeated in the repeating step to be few. Further, conversely, when the number of times that the unit operation is repeated in the repeating step is many, it suffices for the extent to which the temperature of the working fluid with which the refrigeration cycle is charged in the charging step and/or the pressure inside the refrigeration cycle when stopping charging in the charging step are/is to be raised to be few.

Thus, it becomes possible to obtain a more reliable cleaning effect by performing cleaning of the inside of the refrigeration cycle that corresponds to the correlation between temperature/pressure and the number of times of repetition.

An air conditioner cleaning method pertaining to a sixth aspect of the present invention comprises the air conditioner cleaning method pertaining to the fifth aspect of the present invention, wherein in the repeating step, the unit operation is repeated a predetermined number of times that has been determined beforehand. Additionally, in the charging step, the refrigeration cycle is charged with the working fluid so as to follow a condition of a temperature that corresponds to the predetermined number of times and/or a pressure inside the refrigeration cycle that corresponds to the predetermined number of times.

Here, even when the number of times that the repeating step is repeated is fixed beforehand to a predetermined number of times, in the charging step, the refrigeration cycle is charged with the working fluid so as to follow a condition of a temperature that corresponds to the predetermined number of times and/or a pressure inside the refrigeration cycle that corresponds to the predetermined number of times.

Thus, even when the number of times of repetition is held at a constant, it becomes possible to obtain a certain cleaning effect.

An air conditioner cleaning method pertaining to a seventh aspect of the present invention comprises the air conditioner cleaning method pertaining to the fifth aspect of the present invention, wherein in the charging step, a predetermined temperature during charging of the refrigeration cycle with the working fluid and/or a predetermined pressure inside the refrigeration cycle during charging of the refrigeration cycle with the working fluid are/is charged in a condition that has been determined beforehand. Additionally, in the repeating step, the unit operation is repeated a number of times that corresponds to the predetermined temperature and/or the predetermined pressure.

Here, even when the temperature during charging of the refrigeration cycle with the working fluid is fixed beforehand to a predetermined temperature and/or the pressure inside the refrigeration cycle during charging of the refrigeration cycle with the working fluid is fixed beforehand to a predetermined pressure, in the repeating step, the unit operation is repeated a number of times that corresponds to the predetermined temperature and/or the predetermined pressure.

Thus, even when the pressure/temperature are/is fixed beforehand to predetermined value(s) and the refrigeration cycle is charged, it becomes possible to obtain a certain cleaning effect.

An air conditioner cleaning method pertaining to an eighth aspect of the present invention comprises the air conditioner cleaning method pertaining to any of the first aspect of the present invention to the seventh aspect of the present invention, wherein in the charging step, the concentration of a predetermined component, which is a component other than the working refrigerant and other than the working fluid, of components included in vented charging medium is sensed and, in accordance with the sensed value, the temperature and/or the pressure of the working fluid with which the refrigeration cycle is charged in the charging step that is performed next are/is adjusted.

Here, in the charging step, sensing of the concentration of the predetermined component included in the vented charging medium is performed, and this value is utilized in the adjustment of the temperature and/or the pressure of the working fluid in the next charging step.

Thus, in consideration of the circumstance of charging the refrigeration cycle with the working fluid and the effect of removing impurities, it becomes possible to identify a charging condition and a number of times of repetition for more efficiently recovering impurities.

An air conditioner cleaning method pertaining to a ninth aspect of the present invention comprises the air conditioner cleaning method pertaining to the eighth aspect of the present invention, wherein water is included in the predetermined component. Additionally, in the charging step, the inside of the refrigeration cycle is heated such that the temperature inside the refrigeration cycle becomes a temperature that exceeds the boiling point of the water that corresponds to the pressure inside the refrigeration cycle. It will be noted that the pressure inside the refrigeration cycle here may be the partial pressure of the water inside the refrigeration cycle. Further, the target of heating may be the working fluid with which the refrigeration cycle is charged or part of the refrigeration cycle.

Here, when water is included as an impurity that is present inside the refrigeration cycle, the boiling point of the water also rises as the pressure inside the refrigeration cycle rises in the charging step. With respect thereto, here, the inside of the refrigeration cycle is heated in accordance with the pressure inside the refrigeration cycle, whereby the temperature is raised and it becomes easier for the water to be present in a gaseous state.

Thus, when impurities inside the refrigeration cycle are to be reduced by charging the refrigeration cycle with the working fluid, a large quantity of water can be included in the venting target, and it becomes possible to reliably reduce water inside the refrigeration cycle. Because water inside the refrigeration cycle is reduced in this manner, it becomes possible to prevent the occurrence of freezing in the refrigeration cycle, reduce oxides or the like that arise as a result of the refrigerant pipes and water contacting each other, and prevent erosion of the apparatus.

An air conditioner cleaning method pertaining to a tenth aspect of the present invention comprises the air conditioner cleaning method pertaining to any of the first aspect of the present invention to the ninth aspect of the present invention, wherein the refrigeration cycle includes one heat source unit, plural utilization units, and communication pipes in which branching portions are disposed in order to connect the plural utilization units in parallel with respect to the one heat source unit. Additionally, the charging step, the venting step and the repeating step are performed using at least the branching portions as a target.

When cleaning by conventional vacuuming is performed using, as a target, a refrigeration cycle that includes branching portions configured as a result of plural utilization units being connected with respect to one heat source unit, even when a sufficient effect is obtained in regard to cleaning of portions whose flow resistance is small, it is difficult to obtain a sufficient cleaning effect in the branching portions whose flow resistance is large. Additionally, there is the potential for impurities to end up remaining in the branching portions.

With respect thereto, here, the steps of charging the refrigeration cycle with the working fluid and venting the charging target are repeated using the branching portions as a target, so it becomes possible to improve the cleaning effect even at the branching portions whose flow resistance is large.

An air conditioner pertaining to an eleventh aspect of the present invention is an air conditioner where carbon dioxide is used as a working refrigerant, and the air conditioner comprises: a refrigeration cycle and a counter. The refrigeration cycle is capable of repeatedly performing, at least one time or more, a unit operation of charging the refrigeration cycle with a working fluid and thereafter venting a charging target. The counter counts and outputs the number of times that the unit operation has been performed. It will be noted that, in the output resulting from the counter here, there is included not only the output of count data with respect to a display device such as a display but also a case where count data are transmitted with respect to another device. Further, it is not particularly necessary for the working fluid for cleaning here to have a function as a refrigerant during air conditioning, and carbon dioxide and nitrogen or the like are included.

Here, the refrigeration cycle is charged with the working fluid, whereby the relative concentration of impurities inside the refrigeration cycle can be reduced. Additionally, the charging target including impurities with which the refrigeration cycle is charged is vented to the outside of the refrigeration cycle without having to perform conventional vacuuming of the refrigeration cycle, whereby some of the impurities that had been present inside the refrigeration cycle are also vented to the outside of the refrigeration cycle, and the absolute quantity of impurities inside the refrigeration cycle is reduced. The unit operation of charging the refrigeration cycle with the working fluid and thereafter venting the charging target is repeated at least one time or more, whereby it becomes possible to further reduce the quantity of impurities inside the refrigeration cycle. Here, the number of times that the unit operation has been performed can be obtained by the counter, so it becomes possible to predict the quantity of impurities remaining inside the refrigeration cycle.

Thus, it becomes possible to reduce the quantity of impurities inside an existing refrigeration cycle that is charged with carbon dioxide as a working refrigerant without having to perform vacuuming. Additionally, because the quantity of impurities inside the refrigeration cycle is made predictable, it becomes possible to predict the number of times of repetition of the unit operation that becomes necessary in order to satisfy the allowable range of the quantity of impurities inside the refrigeration cycle.

An air conditioner pertaining to a twelfth aspect of the present invention comprises the air conditioner pertaining to the eleventh aspect of the present invention and further comprises a judging unit that judges whether or not to end repetition of the unit operation on the basis of the number of times that is obtained by the output of the counter.

Here, not only can the number of times that the unit operation has been repeated be obtained by the counter, but it becomes possible to automatize judgment in regard to whether or not to end the repetition processing.

An air conditioner pertaining to a thirteenth aspect of the present invention comprises the air conditioner pertaining to the twelfth aspect of the present invention, wherein the judging unit judges such that the unit operation is repeated a number of times that corresponds to the temperature of the working fluid with which the refrigeration cycle is charged and/or the pressure inside the refrigeration cycle after being charged with the working fluid.

Here, a number of times of repetition that corresponds to the temperature/pressure circumstance is determined by the judging unit, so the reliability of the cleaning effect can be improved.

An air conditioner pertaining to a fourteenth aspect of the present invention comprises the air conditioner pertaining to the twelfth aspect of the present invention or the thirteenth aspect of the present invention and further comprises a sensing unit that senses the concentration of a predetermined component, which is a component other than the working refrigerant and other than the working fluid, of components included in vented charging medium. Additionally, the judging unit judges such that the unit operation is repeated a number of times that corresponds to the concentration of the predetermined component that the sensing unit senses. It will be noted that, when the predetermined component is water, for example, there is included repeating the unit operation until the concentration of the water becomes equal to or less than 10 ppm and more preferably equal to or less than 100 ppm.

Here, the judging unit judges such that the unit operation is repeated in accordance with the concentration of the predetermined component that is sensed by the sensing unit, so it becomes possible to further improve the reliability of the cleaning effect.

An air conditioner pertaining to a fifteenth aspect of the present invention comprises the air conditioner pertaining to the twelfth aspect of the present invention to the fourteenth aspect of the present invention and further comprises a control unit that performs charging and venting control to perform charging of the refrigeration cycle with the working fluid and thereafter venting of the charging target from the refrigeration cycle and which, when it is judged in the judging unit to end repetition of the unit operation, stops the charging and venting control.

Here, when the judging unit has judged to end repetition, the control unit stops the charging and venting control, whereby it becomes possible to automatize ending the charging and venting processing.

An air conditioner of a sixteenth aspect of the present invention comprises the air conditioner pertaining to any of the eleventh aspect of the present invention to the fifteenth aspect of the present invention, wherein the refrigeration cycle includes one heat source unit, plural utilization units, and communication pipes in which branching portions are disposed in order to connect the plural utilization units in parallel with respect to the one heat source unit. Additionally, the unit operation of charging the refrigeration cycle with the working fluid and thereafter venting the charging target is performed at least one time or more using at least the branching portions as a target.

When cleaning by conventional vacuuming is performed using, as a target, a refrigeration cycle that includes branching portions configured as a result of plural utilization units being connected with respect to one heat source unit, even when a sufficient effect is obtained in regard to cleaning of portions whose flow resistance is small, it is difficult to obtain a sufficient cleaning effect in the branching portions whose flow resistance is large. Additionally, there is the potential for impurities to end up remaining in the branching portions.

With respect thereto, here, the steps of charging the refrigeration cycle with the working fluid and venting the charging target are repeated using the branching portions as a target, so it becomes possible to improve the cleaning effect even at the branching portions whose flow resistance is large.

Effects of the Invention

In the air conditioner cleaning method of the first aspect of the present invention, the quantity of impurities inside an existing refrigeration cycle that is charged with carbon dioxide as a working refrigerant can be reduced without having to perform vacuuming.

In the air conditioner cleaning method of the second aspect of the present invention, it becomes possible to more efficiently reduce impurities inside the refrigeration cycle.

In the air conditioner cleaning method of the third aspect of the present invention, it becomes possible to avoid a situation where the working fluid for cleaning the inside of the refrigeration cycle ends up remaining inside the refrigeration cycle after the venting step, and the cleaning effect can be raised.

In the air conditioner cleaning method of the fourth aspect of the present invention, it becomes possible to reduce the quantity of the carbon dioxide that is vented when cleaning the refrigeration cycle.

In the air conditioner cleaning method of the fifth aspect of the present invention, it becomes possible to obtain a more reliable cleaning effect by performing cleaning of the inside of the refrigeration cycle that corresponds to the correlation between temperature/pressure and the number of times of repetition.

In the air conditioner cleaning method of the sixth aspect of the present invention, even when the number of times of repetition is held at a constant, it becomes possible to obtain a certain cleaning effect.

In the air conditioner cleaning method of the seventh aspect of the present invention, even when the temperature during charging of the refrigeration cycle with the working fluid is fixed beforehand to a predetermined temperature and/or the pressure inside the refrigeration cycle during charging of the refrigeration cycle with the working fluid is fixed beforehand to a predetermined pressure, in the repeating step, the unit operation is repeated a number of times that corresponds to the predetermined temperature and/or the predetermined pressure.

In the air conditioner cleaning method of the eighth aspect of the present invention, in consideration of the circumstance of charging the refrigeration cycle with the working fluid and the effect of removing impurities, it becomes possible to identify a charging condition and a number of times of repetition for more efficiently recovering impurities.

In the air conditioner cleaning method of the ninth aspect of the present invention, when impurities inside the refrigeration cycle are to be reduced by charging the refrigeration cycle with the working fluid, it becomes possible to reliably reduce water inside the refrigeration cycle.

In the air conditioner cleaning method of the tenth aspect of the present invention, it becomes possible to improve the cleaning effect even at the branching portions whose flow resistance is large.

In the air conditioner of the eleventh aspect of the present invention, it becomes possible to reduce the quantity of impurities inside an existing refrigeration cycle that is charged with carbon dioxide as a working refrigerant without having to perform vacuuming. Additionally, because the quantity of impurities inside the refrigeration cycle is made predictable, it becomes possible to predict the number of times of repetition of the unit operation that becomes necessary in order to satisfy the allowable range of the quantity of impurities inside the refrigeration cycle.

In the air conditioner of the twelfth aspect of the present invention, not only can the number of times that the unit operation has been repeated be obtained by the counter, but it becomes possible to automatize judgment in regard to whether or not to end the repetition processing.

In the air conditioner of the thirteenth aspect of the present invention, a number of times of repetition that corresponds to the temperature/pressure circumstance is determined by the judging unit, so the reliability of the cleaning effect can be improved.

In the air conditioner of the fourteenth invention, it becomes possible to further improve the reliability of the cleaning effect.

In the air conditioner of the fifteenth aspect of the present invention, when the judging unit has judged to end repetition, the control unit stops the charging and venting control, whereby it becomes possible to automatize ending the charging and venting processing.

In the air conditioner of the sixteenth aspect of the present invention, it becomes possible to improve the cleaning effect even at the branching portions whose flow resistance is large.

BRIEF DESCRIPTION OF THE DRAWINGS

FIG. 5 is a diagram showing numbers of times that charging and venting are to be repeated, as differentiated by condition, in a refrigeration cycle cleaning method pertaining to modification (G).

BEST MODE FOR CARRYING OUT THE INVENTION

Below, an embodiment of an air conditioner pertaining to the present invention will be described on the basis of the drawings.

<General Configuration of Air Conditioner 1>

Figure 1:
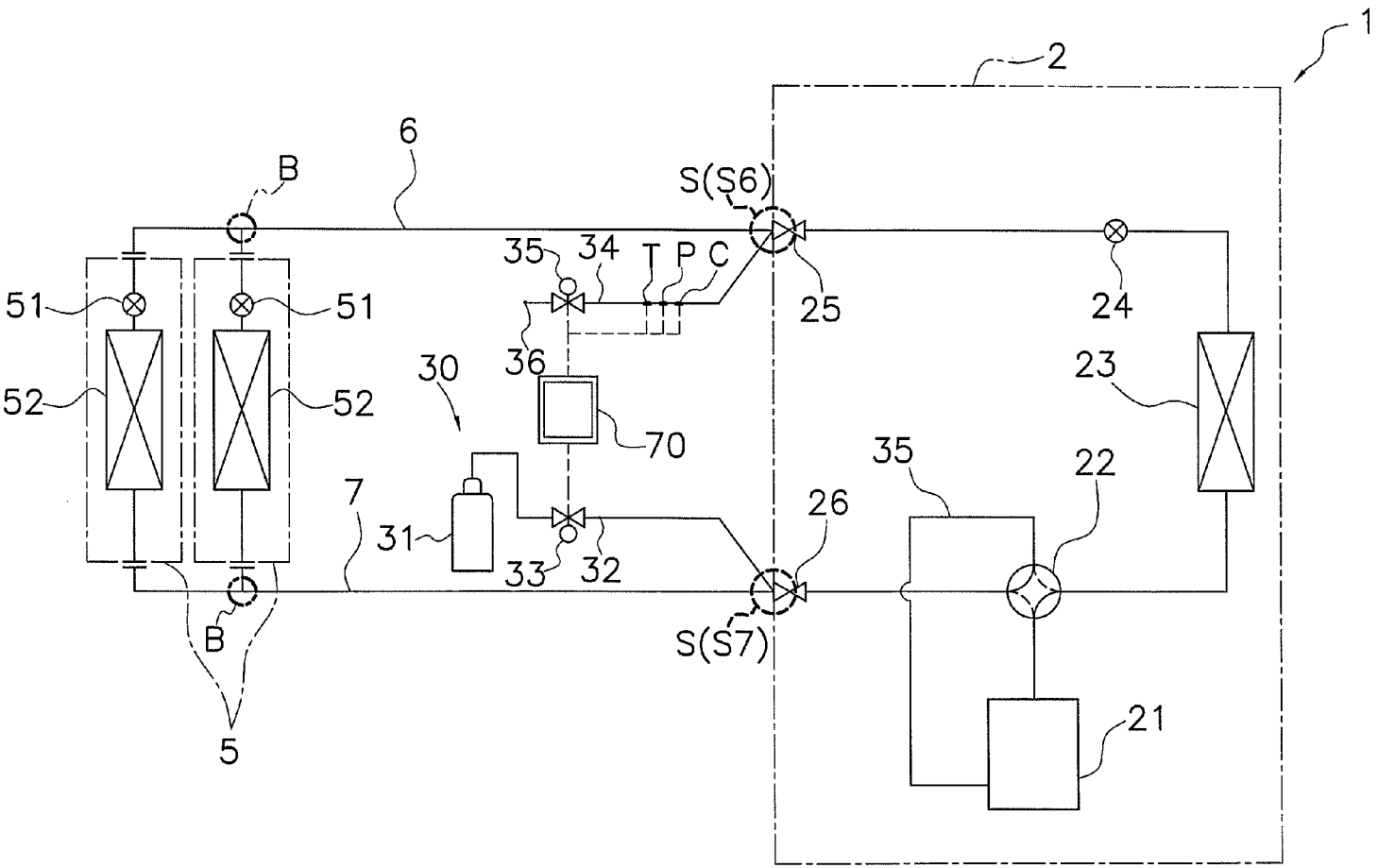
FIG. 1 is a diagram showing a refrigerant circuit of an air conditioner pertaining to an embodiment of the present invention.

FIG. 1 is a general diagram of a refrigerant circuit of an air conditioner 1.

The air conditioner 1 is a multi type apparatus that is used in air conditioning such as cooling and heating the inside of a building structure such as a building, and the air conditioner 1 is disposed with one heat source unit 2, plural (in the present embodiment, two) utilization units 5 where carbon dioxide is used as a working refrigerant and which are connected in parallel to the heat source unit 2, a liquid refrigerant pipe 6 and a gas refrigerant pipe 7 for interconnecting the heat source unit 2 and the utilization units 5, service ports S and a controller 70.

(Heat Source Unit)

The heat source unit 2 is installed on the roof of the building structure or the like and is mainly configured by a compressor 21, a four-way switch valve 22, a heat source heat exchanger 23, a heat source expansion valve 24, a liquid close valve 25, a gas close valve 26 and refrigerant pipes that interconnect these.

The compressor 21 is a device for sucking in and compressing gas refrigerant. The four-way switch valve 22 is a valve for switching the direction of the flow of the refrigerant inside the refrigerant circuit when switching between cooling operation and heating operation. The four-way switch valve is configured such that, during cooling operation, the four-way switch valve is capable of interconnecting a discharge side of the compressor 21 and a gas side of the heat source heat exchanger 23 and also interconnecting a suction side of the compressor 21 and the gas close valve 26, and such that, during heating operation, the four-way switch valve is capable of interconnecting the discharge side of the compressor 21 and the gas close valve 26 and also interconnecting the discharge side of the compressor 21 and the gas side of the heat source heat exchanger 23. The heat source heat exchanger 23 is a heat exchanger that uses air or water as a heat source to evaporate or condense the refrigerant. The heat source expansion valve 24 is a valve that is disposed on a liquid side of the heat source heat exchanger 23 and is for performing adjustment of the refrigerant pressure and the refrigerant flow rate. The liquid close valve 25 and the gas close valve 26 are respectively connected to the liquid refrigerant pipe 6 and the gas refrigerant pipe 7.

(Utilization Units)

The utilization units 5 are installed in various locations inside the building structure and are mainly configured by utilization expansion valves 51, utilization heat exchangers 52 and refrigerant pipes that interconnect these.

The utilization heat exchangers 52 are heat exchangers that evaporate or condense the refrigerant to perform cooling or heating of indoor air. The utilization expansion valves 51 are valves that are disposed on liquid sides of the utilization heat exchangers 52 and are for performing adjustment of the refrigerant pressure and the refrigerant flow rate.

(Refrigerant Pipes)

The liquid refrigerant pipe 6 and the gas refrigerant pipe 7 are refrigerant pipes that interconnect the heat source unit 2 and the utilization units 5, and the major portions of these pipes are disposed inside the walls or on the backsides of the ceilings inside the building structure. Here, as shown in FIG. 1, the plural utilization units 5 are connected with respect to the one heat source unit 2, so branching portions B are disposed in the refrigerant pipes.

(Service Ports)

The service ports S are connection ports for charging a refrigeration cycle with a working refrigerant and venting the working refrigerant from the refrigeration cycle and include a liquid pipe service port S6 that is disposed adjacent to the utilization heat exchanger 52 side of the liquid close valve 25 and a gas pipe service port S7 that is disposed adjacent to the utilization heat exchanger 52 side of the gas close valve 26 and on a suction side of the compressor 21 during cooling operation.

As shown in FIG. 1, a venting pipe 34 that is detachably attached at the time when the refrigeration cycle is charged with the refrigerant and becomes communicated with the liquid refrigerant pipe 6 in an attached state is disposed in the liquid pipe service port S6. The venting pipe 34 is configured such that a venting end 36 is formed on the end portion on the opposite side of the end portion on the liquid pipe service port S6 side, a venting electromagnetic valve 35 is disposed between the end portion on the liquid pipe service port S6 side and the venting end 36, and venting is controlled by the later-described controller 70. As shown in FIG. 1, a temperature sensor T that senses the temperature of the refrigerant and a pressure sensor P that senses the pressure of the refrigerant are respectively disposed in the venting pipe 34. Moreover, a concentration sensor C which, when venting a charging target inside the refrigeration cycle in a later-described venting step S30, senses the concentration of nitrogen that is included in this venting target, is disposed in the venting pipe 34.

As shown in FIG. 1, a charging pipe 32 that is detachably attached at the time when the refrigeration cycle is charged with the refrigerant and becomes communicated with the gas refrigerant pipe 7 in an attached state is disposed in the gas pipe service port S7. The other end of the charging pipe 32 on the opposite side of the end portion on the gas pipe service port S7 side is connected to a canister body 31 of a later-described carbon dioxide canister 30 in which carbon dioxide is enclosed. A charging electromagnetic valve 33 is disposed between the end portion of the charging pipe 32 on the gas pipe service port S7 side and the canister body 31, and charging can be controlled by the later-described controller 70.

(Controller)

Figure 2:
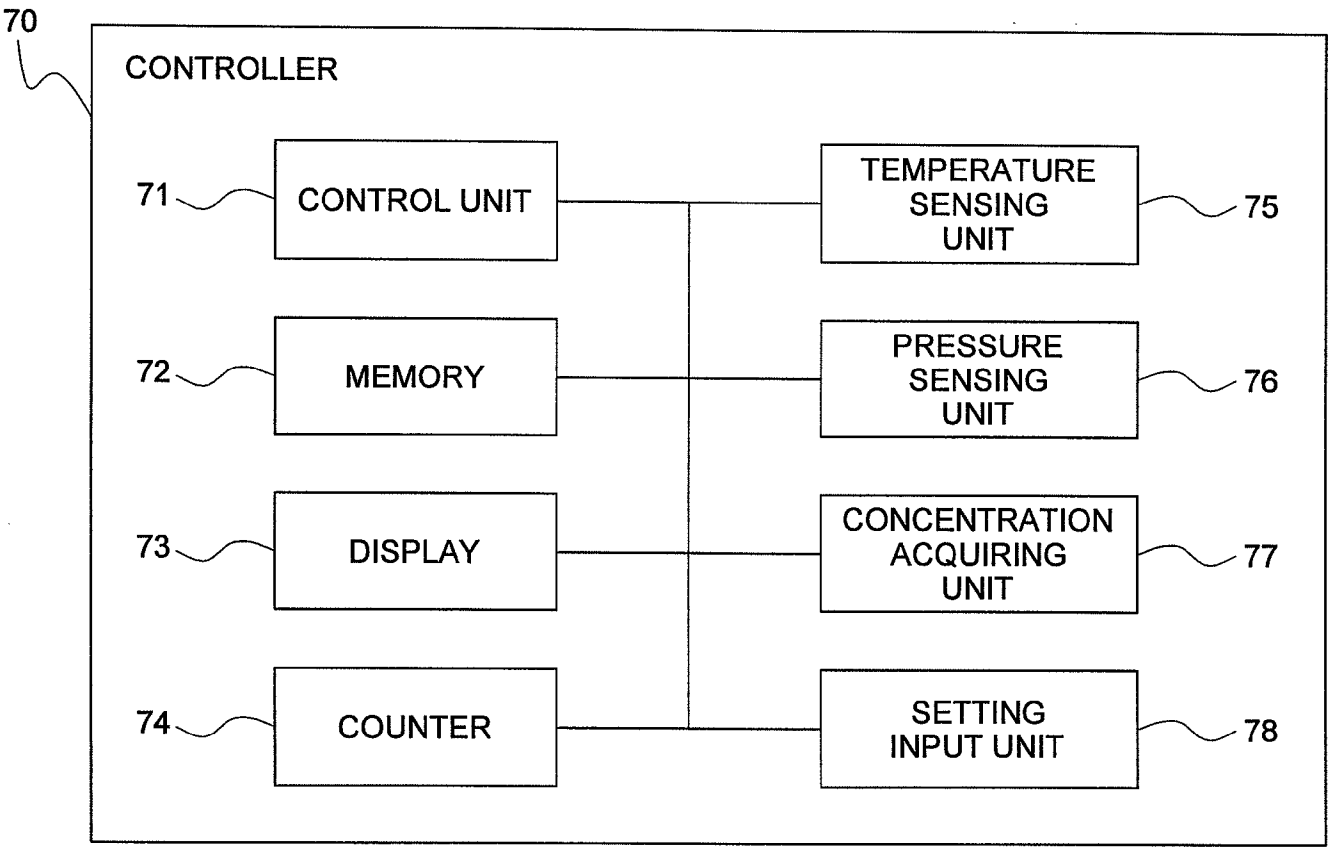
FIG. 2 is a block diagram of a controller of the air conditioner.

The controller 70 is a device that performs later-described air conditioning operation and cleaning control and, as shown in FIG. 2, includes a control unit 71, a memory 72, a display 73, a counter 74, a temperature sensing unit 75, a pressure sensing unit 76, a concentration acquiring unit 77 and a setting input unit 78. The control unit 71 performs control of air conditioning operation and performs control of cleaning processing in regard to the refrigeration cycle. The memory 72 stores data that have been inputted from the setting input unit 78 or the like and count data resulting from the counter 74. Here, the counter 74 performs counting using, as a unit operation, three processes of a charging step S10, a standby step S20 and a venting step S30, which will be described later. The display 73 receives instructions from the control unit 71 and performs display in accordance with the stored content of the memory 72 in regard to the count data resulting from the counter 74 and the like. The temperature sensing unit 75 acquires data obtained from the temperature sensor T. The pressure sensing unit 76 acquires data obtained from the pressure sensor P. The concentration acquiring unit 77 acquires data obtained from the concentration sensor C.

<Air Conditioning Operation of Air Conditioner 1>

Next, cooling operation of the air conditioner 1 in a state where installation with respect to the building structure has been completed will be described using FIG. 1. Control of each type of configuration devices in cooling operation is performed by the control unit 71 of the air conditioner 1 that functions as normal control means.

When the liquid close valve 25 and the gas close valve 26 are placed in a completely opened state and a cooling operation command is issued from the control unit 71, the compressor 21 starts up. Then, low pressure refrigerant is sucked into the compressor 21 and becomes high pressure refrigerant that has been compressed until its pressure exceeds a critical pressure. Thereafter, the high pressure refrigerant is sent to the outdoor heat exchanger 23, performs heat exchange with outdoor air in the outdoor heat exchanger 23 that functions as a cooler, and is cooled.

Then, the high pressure refrigerant that has been cooled in the outdoor heat exchanger 23 passes through the liquid refrigerant pipe 6 and the liquid close valve 25 and is sent to the utilization units 5. The high pressure refrigerant that has been sent to the utilization units 5 is sent to the utilization expansion valves 51, is depressurized until its pressure becomes lower than the critical pressure (that is, a pressure close to the suction pressure of the compressor 21) by the utilization expansion valves 51, becomes low pressure refrigerant in a gas-liquid two-phase state, is sent to the indoor heat exchangers 52, performs heat exchange with indoor air in the indoor heat exchangers 52 that function as evaporators, evaporates, and becomes low pressure refrigerant.

Then, the low pressure refrigerant that has evaporated in the indoor heat exchangers 52 is sent to the heat source unit 2, passes through the gas refrigerant pipe 7 and the gas close valve 26, and is again sucked into the compressor 21.

In this manner, air conditioning operation of the air conditioner 1 is performed.

<Air Tightness Test with Nitrogen Gas>

Here, the air conditioner 1 that performs the aforementioned air conditioning operation is configured as a result of mainly the four elements of the heat source unit 2, the utilization units 5, the liquid refrigerant pipe 6 and the gas refrigerant pipe 7 being connected to each other, and the air conditioner 1 is installed in a building structure. Additionally, first, whether or not there is air tightness is checked in regard to each of the three elements of the utilization units 5, the liquid refrigerant pipe 6 and the gas refrigerant pipe 7. Here, as shown in FIG. 1, air tightness is checked using, as a target, all pipe portions from the liquid close valve 25 to the gas close valve 26 in a state where the utilization units 5, the liquid refrigerant pipe 6 and the gas refrigerant pipe 7 are connected to each other.

The test of air tightness here is performed by charging the insides of the pipes with nitrogen gas using, as a target, the utilization units 5, the liquid refrigerant pipe 6 and the gas refrigerant pipe 7 that are connected to each other. Whether or not there is a leak at this time is judged by allowing an appropriate concentration of foaming liquid such as soapy water (and to which several drops of glycerin has been added to this) to sufficiently spread to each screwed portion, joint portion, welded portion, and all places where leaking may be expected and by checking whether or not there is foam resulting from the foaming liquid.

When air tightness is verified by the above air tightness test, it can be certified that there is no potential in the air conditioner 1 for the working refrigerant to leak even if the refrigeration cycle were to be charged with the working refrigerant and the air conditioner 1 were to perform operation.

<Cleaning Processing of Air Conditioner 1>

As described above, an air tightness test is performed in regard to the utilization units 5, the liquid refrigerant pipe 6 and the gas refrigerant pipe 7, and in a state where it has been verified that air tightness is secured in regard to these three elements that configure the refrigeration cycle, uncondensed gas (mainly nitrogen gas) such as air that was used in the air tightness test ends up remaining inside these three elements.

Additionally, the air conditioner 1 of the present embodiment configures a refrigeration cycle that uses carbon dioxide as the working refrigerant, so this residual air (mainly nitrogen) and the like is positioned as an impurity with respect to carbon dioxide in the working refrigerant. When the refrigeration cycle is charged with carbon dioxide as the working refrigerant and air conditioning operation is performed in a state where such an impurity is present in the refrigeration cycle, pressure in the high-pressure side ends up becoming abnormally high, and problems arise in each of the elements, such as an increase in electrical power consumption and a drop in air conditioning capability.

For this reason, here, it is necessary to remove the air (mainly nitrogen, etc.) that remains inside each of the pipes in the utilization units 5, the liquid refrigerant pipe 6 and the gas refrigerant pipe 7 that configure the air conditioner 1, and cleaning processing that utilizes, as a cleaning agent, carbon dioxide of the same component as the working refrigerant and discharges the air is performed.

(Configuration Used in Cleaning Processing)

Here, as shown in FIG. 1, the cleaning processing is executed as a result of, in regard to the charging side, the gas pipe service port S7 being connected to the carbon dioxide canister 30 via the charging pipe 32 and, in regard to the venting side, the liquid pipe service port S6 being connected to the venting pipe 34.

The venting pipe 34 is connected to the liquid pipe service port S6, and during charging, in order to stop venting of the refrigerant from the venting end 36, the opening and closing of the venting electromagnetic valve 33 is controlled by the control unit 71 so as to become closed.

Here, the carbon dioxide canister 30 includes, as shown in FIG. 1, the canister body 31, the charging pipe 32 and the charging electromagnetic valve 33. Carbon dioxide is enclosed in a high pressure state in the canister body 31. The charging tube 32 charges the refrigeration cycle with carbon dioxide in a gaseous state via the gas pipe service port S7 by interconnecting the canister body 31, in which is enclosed carbon dioxide of the same component as the working refrigerant of the air conditioner 1, and the aforementioned gas pipe service port S7. The opening and closing of the charging electromagnetic valve 33 is controlled by the control unit 71, whereby the quantity of the carbon dioxide with which the refrigeration cycle is charged is adjusted, and the pressure inside the refrigeration cycle is also adjusted.

Here, as shown in FIG. 1, the temperature acquiring unit 75 of the controller 70 is connected to the temperature sensor T, the pressure acquiring unit 76 is connected to the pressure sensor S, and the concentration acquiring unit 77 is connected to the concentration sensor C. Additionally, the control unit 71 performs control of the cleaning processing of the refrigeration cycle on the basis of each piece of data that the temperature sensor T, the pressure sensor S and the concentration sensor C acquire. Specifically, the control unit 71 performs charging and venting control in the cleaning processing by controlling the opening of the charging electromagnetic valve 33 on the basis of the pressure data that the pressure acquiring unit 76 acquires and controlling the opening of the venting electromagnetic valve on the basis of the nitrogen concentration that the concentration acquiring unit 77 acquires. Thus, the pressure inside the refrigeration cycle in the cleaning processing can be automatically adjusted, and the number of times that the cleaning processing is repeated can be adjusted.

(Flowchart of Cleaning Processing)

Figure 3:
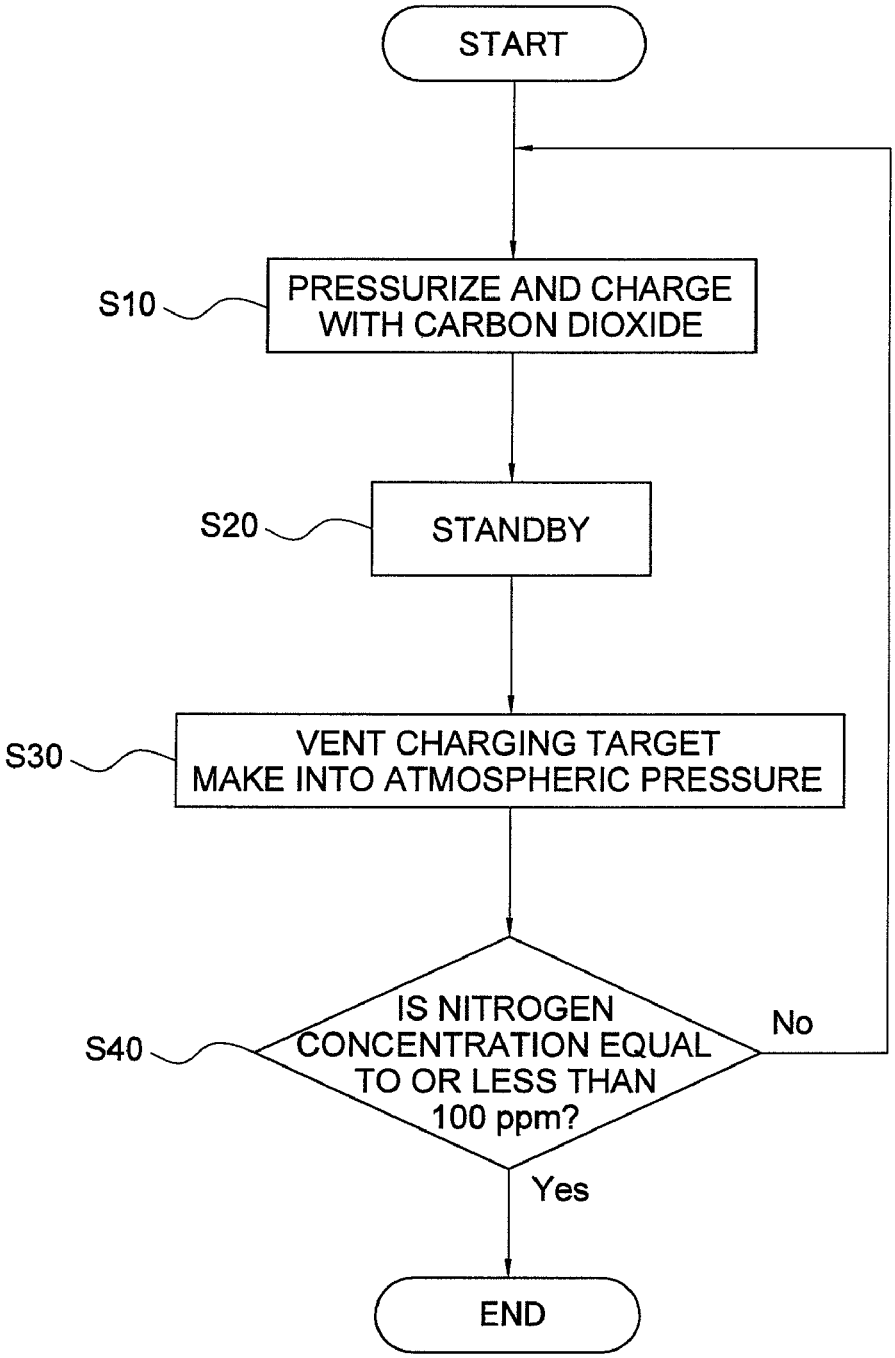
FIG. 3 is a flowchart of refrigeration cycle cleaning processing.

FIG. 3 shows a flowchart of the cleaning processing by the controller 70.

Here, there will be described a flow of control that the controller 70 performs and which starts from a state where the carbon dioxide canister 30 has been connected to the charging service port S7. Further, there will be described a case where, when the cleaning processing here is performed with the goal of making the residual nitrogen concentration in the refrigeration cycle equal to or less than 100 ppm, before the cleaning processing is performed, a service engineer sets a predetermined pressure in charging as 10 atm by operating and inputting the setting input unit 78 of the controller 70.

(S10: Step of Automatically Charging Refrigeration Cycle with Carbon Dioxide)

First, in step S10, the controller 70 places all of the valves disposed in the refrigeration cycle (specifically, the heat source expansion valve 24, the liquid close valve 25, the gas close valve 26 and the utilization expansion valves 51 or the like) in a completely opened state and controls automatic charging of the refrigeration cycle such that, in order to initiate charging of the refrigeration cycle in this completely opened state with carbon dioxide gas, the charging electromagnetic valve 33 is placed in an "opened" state and the venting electromagnetic valve 35 is placed in a "closed" state. Because each valve is in an "opened" state, the carbon dioxide gas pervades every corner of the utilization units 5, the liquid refrigerant pipe 6 and the gas refrigerant pipe 7 of the refrigeration cycle. For this reason, the inside of the refrigeration cycle becomes pressurized and charged with the carbon dioxide gas that is the same component as the working refrigerant of the air conditioner 1. Thus, even in the branching portions B where the refrigerant pipes branch and have a complex configuration, the carbon dioxide gas and the nitrogen as an impurity sufficiently mix together. Additionally, the control unit 71 performs control to place in an "opened" state the charging electromagnetic valve 33 and continue charging until the pressure value that the pressure acquiring unit 76 acquires becomes the 10 atm that was set as the predetermined pressure and performs control to place in a "closed" state the charging electromagnetic valve 33 and end charging when the pressure value reaches the 10 atm that is the predetermined pressure (here also, the venting electromagnetic valve 35 is maintained in a "closed" state). At this stage, the counter 74 stores count data as "1 time" in the memory 72 and, in accordance with the count data stored in the memory 72, the control unit 71 causes the display 73 to display "1 time" in order to indicate that the unit operation is the first unit operation.

(S20: Standby Step)

Next, in step S20, the controller 70 maintains, for a predetermined amount of time (e.g., 10 minutes), the state where the refrigeration cycle has been charged with the carbon dioxide gas at the predetermined pressure (10 atm). Thus, the carbon dioxide gas with which the refrigeration cycle has been charged and the nitrogen that remains inside the refrigeration cycle sufficiently mix together. The amount of standby time here may also be such that adjustment to shorten the amount of standby time to an appropriate amount of time in the case of high pressure/high temperature, for example, is performed in accordance with the pressure and temperature state of the carbon dioxide gas with which the refrigeration cycle is charged.

(S30: Step of Automatically Venting Charging Target)

Then, in step S30, when the control unit 71 of the controller 70 judges that the amount of standby time has exceeded the predetermined amount of time, the control unit 71 places the venting electromagnetic valve 35 in an "opened" state and vents, from the venting end 36, the carbon dioxide gas with which the utilization units 5, the liquid refrigerant pipe 6 and the gas refrigerant pipe 7 of the refrigeration cycle are charged and the nitrogen as an impurity. The venting here is performed until it is judged by the control unit 71 on the basis of the value of the pressure sensor P that the pressure acquiring unit 76 acquires that the pressure has fallen to atmospheric pressure.

In the above processing, in the charging step S10, for example, when the total pressure of the refrigeration cycle has been raised to 10 atm, the partial pressure of the nitrogen that is an impurity becomes 0.5 atm, and the ratio of the partial pressure of the impurity with respect to the total pressure of becomes smaller. Additionally, when the inside of the refrigeration cycle is returned to atmospheric pressure in the venting of the charging target by the venting step S30, the partial pressure of the nitrogen in the refrigeration cycle whose total pressure is 1 atm, for example, is reduced to about 0.05 atm. In this manner, the refrigeration cycle is cleaned.

(S40: Determining Concentration of Nitrogen in Charging Target and Repetition Processing)

In step S40, the concentration acquiring unit 77 acquires, from the concentration sensor C, the concentration of the nitrogen in the components that have been vented in the preceding venting step S30. Then, the control unit 71 of the controller 70 judges whether or not the nitrogen concentration that the concentration acquiring unit 77 has acquired is equal to or less than 100 ppm, which is a residual nitrogen concentration of goal tolerance. Here, when the nitrogen concentration is not equal to or less than 100 ppm, the control unit 71 returns to step S10 and again repeats the cleaning processing resulting from charging the refrigeration cycle with the carbon dioxide gas and venting the charging target. In this case, the counter 74 advances the count data to "2 times" and stores this in the memory 72, and in accordance with the count data stored in the memory 72, the control unit 71 causes the display 73 to display "2 times" in order to indicate that the unit operation is the second unit operation. On the other hand, when the nitrogen concentration is equal to or less than 100 ppm, the control unit 71 judges that the nitrogen has been sufficiently removed from the refrigeration cycle and ends the cleaning processing.

<Charging of Refrigeration Cycle with Additional Carbon Dioxide as Working Refrigerant>

In the refrigeration cycle that is installed in the building structure in this manner and which has been cleaned such that the residual nitrogen concentration becomes equal to or less than 100 ppm, it is necessary to adjust the quantity of the refrigerant with which the refrigeration cycle is charged to an optimum quantity resulting from the pipe lengths and the like taking various configurations. For this reason, the liquid close valve 25 and the gas close valve 26 are opened and the refrigeration cycle is charged with a quantity of additional refrigerant that corresponds to the portion that is insufficient with only the quantity of carbon dioxide refrigerant as the working refrigerant that the heat source unit 2 is disposed with beforehand. The additional quantity of carbon dioxide with which the refrigeration cycle is charged here is a quantity where the refrigeration capacity of the refrigeration cycle is maximally exhibited and where problems such as abnormal pressure or the like do not arise. Thus, it becomes possible to perform the aforementioned air conditioning operation using the refrigeration cycle from which impurities have been removed.

<Characteristics of Cleaning Processing of Air Conditioner 1 of Present Embodiment>

(1)

In a conventional air conditioner, in order to remove nitrogen remaining in a refrigeration cycle whose air tightness has been verified by an air tightness test, vacuuming to lower the air pressure inside the refrigeration cycle and remove impurities is performed. For this reason, an operation for vacuuming and a device for vacuuming end up becoming separately necessary. It is necessary for a vacuum pump that performs such vacuuming to place the refrigeration cycle in a vacuum state as far as −100 kPa, and a large device ends up becoming necessary.

In contrast, according to the method of cleaning the air conditioner 1 of the present embodiment, the refrigeration cycle is charged with carbon dioxide gas of the same component as the working refrigerant, and the carbon dioxide gas pervades every corner inside the refrigeration cycle by pressurization charging. For this reason, the carbon dioxide gas and the nitrogen can be sufficiently mixed together. Thus, when the charging target is vented, some of the nitrogen remaining inside the refrigeration cycle is discharged to the outside of the refrigeration cycle together with the carbon dioxide gas with which the refrigeration cycle had been pressurized and charged, and the absolute quantity of the nitrogen inside the refrigeration cycle can be reduced. Thus, the nitrogen remaining in the utilization units 5, the liquid refrigerant pipe 6 and the gas refrigerant pipe 7 of the refrigeration cycle is discharged to the outside of the refrigeration cycle without having to perform conventional vacuuming of the refrigeration cycle.

Moreover, by repeating the above operation by the repeating step S40, the concentration of the nitrogen remaining inside the refrigeration cycle can be reduced to a target concentration.

Thus, the residual nitrogen concentration inside the refrigeration cycle can be effectively reduced without having to perform vacuuming.

It will be noted that, as mentioned above, because it is not necessary to perform conventional vacuuming to remove the nitrogen inside the refrigeration cycle, electrical power that had been needed when performing vacuuming becomes unnecessary, and electrical power consumption during construction can be reduced. Moreover, because a vacuum pump becomes unnecessary, initial costs are reduced and maintainability is improved in comparison to a cleaning method where conventional vacuuming is performed.

(2)

In the method of cleaning the air conditioner 1 of the present embodiment, carbon dioxide gas is used to clean the refrigeration cycle, but even if the carbon dioxide were to remain inside the refrigeration cycle, it does not become an impurity inside the refrigeration cycle because the working refrigerant of the air conditioner 1 of the present embodiment is carbon dioxide of the same component, and the relative concentration of impurities inside the refrigeration cycle can be reduced while ensuring that problems do not arise.

Further, by repeating the processes of charging the refrigeration cycle with carbon dioxide of the same component as the working refrigerant and venting the carbon dioxide in the same manner as described above, the relative concentration inside the refrigeration cycle of not only nitrogen as an impurity but also water, dust and scales can be reduced and cleaned.

(3)

In the method of cleaning the air conditioner 1 of the present embodiment, carbon dioxide, whose water solubility is higher than that of nitrogen, is employed as the component with which the refrigeration cycle is charged (e.g., whereas the solubility of nitrogen with respect to 1 liter of water at 1 atm at room temperature is 0.0007 mol, the solubility of carbon dioxide with respect to 1 liter of water at 1 atm at room temperature is 0.053 mol). In the refrigeration cycle, it is preferable to also remove water as an impurity, and such water remaining inside the refrigeration cycle can be effectively discharged together with the carbon dioxide gas with which the refrigeration cycle is charged. Thus, in the cleaning method of the present embodiment that charges the refrigeration cycle with carbon dioxide and vents the carbon dioxide from the refrigeration cycle, water remaining inside the refrigeration cycle can also be effectively discharged, so the effect of cleaning the refrigeration cycle can be improved.

It will be noted that, in comparison to a case where a hydrocarbon such as ethane is used as the working refrigerant of the air conditioner 1, when carbon dioxide is used as the working refrigerant, it is easy for water remaining in the refrigeration cycle to be absorbed during normal air conditioning operation, and there is the potential for the water to become carbonic acid and end up eroding the refrigerant pipes from the inside. With respect thereto, according to the cleaning method of the preceding embodiment, before the refrigeration cycle is charged with carbon dioxide as the working refrigerant and normal air conditioning operation is performed, water inside the refrigeration cycle is sufficiently removed, and it becomes difficult for problems such as erosion of the pipes to occur.

(4)

In the method of cleaning the air conditioner 1 of the present embodiment, in contrast to a conventional method of vacuuming the refrigeration cycle, the refrigeration cycle is pressurized and charged with carbon dioxide gas, and the carbon dioxide gas is allowed to pervade every corner inside the refrigeration cycle. For this reason, even if there are complex portions where a fluid cannot directly flow, such as the branching portions B in the refrigerant pipes of the refrigeration cycle, the carbon dioxide gas and the nitrogen as an impurity can be sufficiently mixed together and discharged. Thus, even the branching portions B of the refrigerant pipes can be sufficiently cleaned.

(5)

In the method of cleaning the air conditioner 1 of the present embodiment, the number of times of processing of the unit operation of the cleaning processing is counted by the counter 74 and is displayed on the display, so a person who performs the cleaning processing can easily verify the number of times of cleaning and can grasp the extent to which the refrigeration cycle is being cleaned.

<Modifications>

(A)

In the air conditioner 1 of the preceding embodiment, there has been taken as an example and described a case where nitrogen, which is an impurity inside the refrigeration cycle, is reduced by pressurizing and charging the refrigeration cycle with carbon dioxide, which is the same component as the working refrigerant, and venting the charging target.

Figure 4:
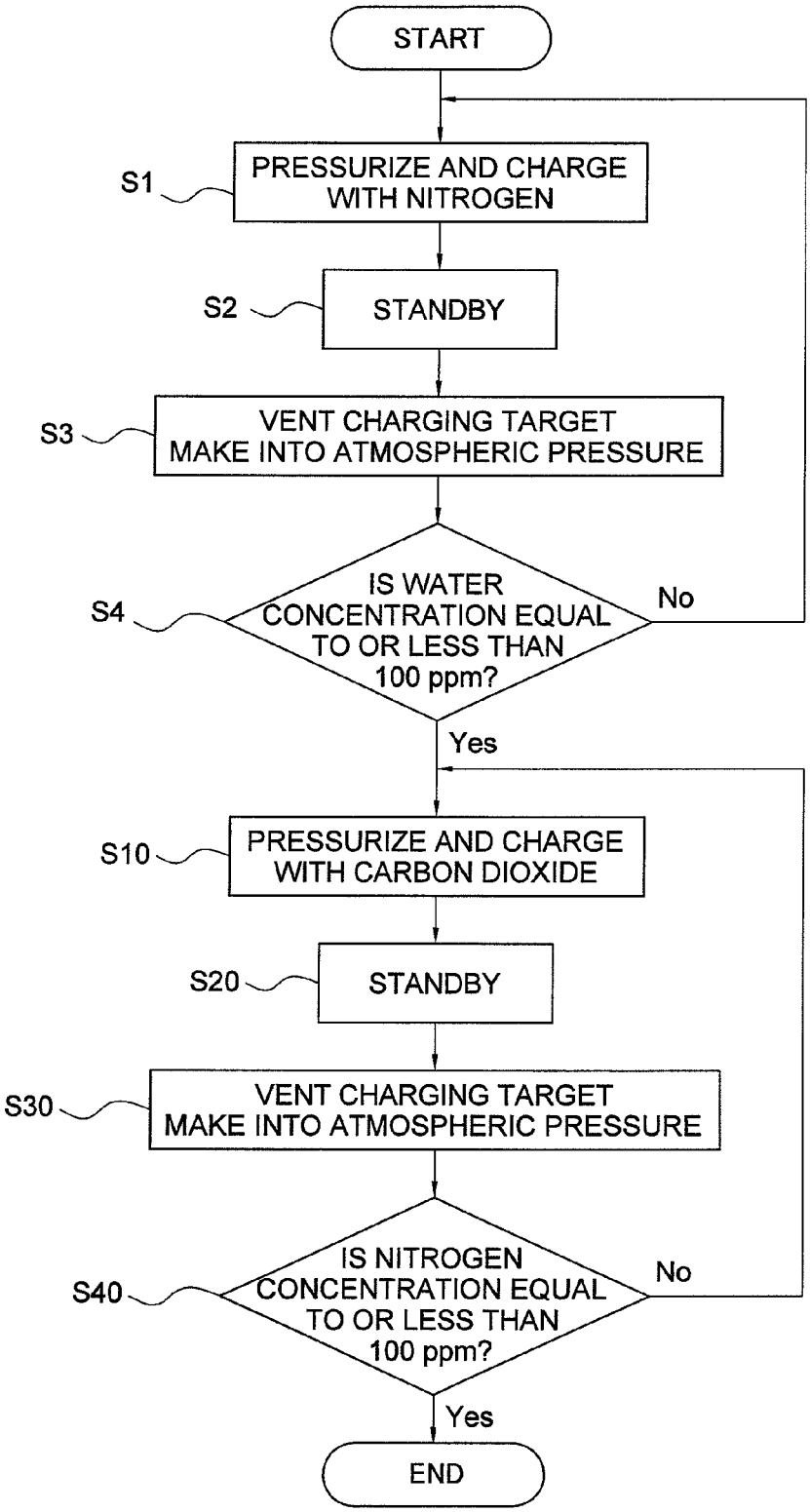
FIG. 4 is a flowchart of refrigeration cycle cleaning processing pertaining to modification (A).

However, the present invention is not limited to this; for example, the invention may also be configured such that, as shown in the flowchart of FIG. 4, before the aforementioned processing to reduce the nitrogen concentration in the refrigeration cycle, in order to remove impurities (e.g., water) other than nitrogen in the refrigeration cycle, processing to pressurize and charge the refrigeration cycle with nitrogen, which is an inactive gas (a gas that has poor chemical reactivity with respect to impurities inside the refrigerant pipes), and vent the nitrogen is repeated. By employing an inactive gas as the gas with which the refrigeration cycle is charged, a situation where the gas chemically reacts with impurities and ends up eroding the pipe walls can be avoided, and an appropriate cleaning effect that corresponds to the quantity of the inactive gas that has been used is obtained.

Specifically, as shown in FIG. 4, before the aforementioned step S10 of charging the refrigeration cycle with carbon dioxide, the standby step S20, the venting step S30 and the repeating step S40 are performed, similar processing to remove water with nitrogen gas in step S1 to step S4 is performed.

(S1: Step of Automatically Charging Refrigeration Cycle with Nitrogen)

First, in step S1, the controller 70 places all of the valves disposed in the refrigeration cycle (specifically, the heat source expansion valve 24, the liquid close valve 25, the gas close valve 26 and the utilization expansion valves 51 or the like) in a completely opened state and controls automatic charging such that, in order to initiate charging of the refrigeration cycle in this completely opened state with nitrogen gas, the charging electromagnetic valve 33 is placed in an "opened" state and the venting electromagnetic valve 35 is placed in a "closed" state. Because each valve of the refrigeration cycle is in an "opened" state, the nitrogen gas pervades every corner of each portion of the refrigeration cycle. Thus, even in the branching portions B where the refrigerant pipes branch and have a complex configuration, the nitrogen gas and the water as an impurity sufficiently mix together. Additionally, the control unit 71 performs control to place in an "opened" state the charging electromagnetic valve 33 and continue charging until the pressure value that the pressure acquiring unit 76 acquires becomes the 10 atm that was set as the predetermined pressure and performs control to place in a "closed" state the charging electromagnetic valve 33 and end charging when the pressure value reaches the 10 atm that is the predetermined pressure (here also, the venting electromagnetic valve 35 is maintained in a "closed" state). At this stage, the counter 74 stores count data as "1 time" in the memory 72 and, in accordance with the count data stored in the memory 72, the control unit 71 causes the display 73 to display "1 time" in order to indicate that the unit operation is the first unit operation.

(S2: Standby Step)

Next, in step S2, the controller 70 maintains, for a predetermined amount of time (e.g., 10 minutes) the state where the refrigeration cycle has been charged with the nitrogen gas at the predetermined pressure (10 atm). Thus, the nitrogen gas with which the refrigeration cycle has been charged and the water that remains in the refrigeration cycle sufficiently mix together. The amount of standby time here may also be such that adjustment to shorten the amount of standby time to an appropriate amount of time in the case of high pressure/high temperature, for example, is performed in accordance with the pressure and temperature state of the nitrogen gas with which the refrigeration cycle is charged.

(S3: Step of Automatically Venting Charging Target)

Then, in step S3, when the control unit 71 of the controller 70 judges that the amount of standby time has exceeded the predetermined amount of time, the control unit 71 places the venting electromagnetic valve 35 in an "opened" state and vents, from the venting end 36, the nitrogen gas with which the utilization units 5, the liquid refrigerant pipe 6 and the gas refrigerant pipe 7 of the refrigeration cycle are charged and the water as an impurity. The venting here is performed until it is judged by the control unit 71 on the basis of the value of the pressure sensor P that the pressure acquiring unit 76 acquires that the pressure has fallen to atmospheric pressure.

In the above processing, in charging step S1, for example, when the total pressure of the refrigeration cycle has been raised to 10 atm, the partial pressure of the water that is an impurity becomes 0.5 atm, and the ratio of the partial pressure of the impurity with respect to the total pressure becomes smaller. Additionally, when the inside of the refrigeration cycle is returned to atmospheric pressure in the venting of the charging target by the venting step S3, the partial pressure of the water in the refrigeration cycle whose total pressure is 1 atm, for example, is reduced to about 0.05 atm. In this manner, the refrigeration cycle is cleaned.

(S4: Determining Concentration of Water in Charging Target and Repetition Processing)

In step S4, the concentration acquiring unit 77 acquires, from the concentration sensor C, the concentration of the nitrogen in the components that have been vented in the venting step S3. Then, the control unit 71 of the controller 70 judges whether or not the nitrogen concentration that the concentration acquiring unit 77 has acquired is equal to or less than 100 ppm, which is a residual nitrogen concentration of goal tolerance. Here, when the nitrogen concentration is not equal to or less than 100 ppm, the control unit 71 returns to step S1 and again repeats the cleaning processing resulting from charging the refrigeration cycle with the nitrogen gas and venting the charging target. In this case, the counter 74 advances the count data to "2 times" and stores this in the memory 72, and in accordance with the count data stored in the memory 72, the control unit 71 causes the display 73 to display "2 times" in order to indicate that the unit operation is the second unit operation. On the other hand, when the nitrogen concentration is equal to or less than 100 ppm, the control unit 71 judges that the water has been sufficiently removed from the refrigeration cycle, ends the water cleaning processing and, as shown in FIG. 4, proceeds to step S110 in order to perform nitrogen cleaning processing. Here, the control unit 71 resets the count data resulting from the counter 74 and returns the count data of the memory 72 to zero.

Subsequently, the processing of each of the charging step S10, the standby step S20, the venting step S30 and the repeating step S40 is the same as in the preceding embodiment.

Thus, in a case where cleaning to reduce the concentration of water in the refrigeration cycle and also to reduce the concentration of nitrogen is to be performed, the total discharge quantity of carbon dioxide that is to be vented can be reduced.

Further, as another example, a component other than nitrogen that has a water adsorbing property may also be employed as a charging object in order to remove water. Thus, when the charging target is to be vented, a larger quantity of water can be discharged in accompaniment with the venting of the adsorbing component, and removal of water in the refrigeration cycle can be effectively performed.

Moreover, as another example, not being limited to water, the invention may also be configured to employ a working fluid that has a selective adsorbing property or a selective absorbing property with respect to impurities of other components and to charge the refrigeration cycle with that working fluid so as to clean the refrigeration cycle.

(B)

In the air conditioner 1 of the preceding embodiment, there has been taken as an example and described a case where cleaning is performed without particular consideration being given to the temperature state of the refrigerant with which the refrigeration cycle is charged.

Here, in the preceding embodiment, when the charging pressure in the charging step S20 ends up being raised too much, sometimes water remaining in the refrigeration cycle cannot be vaporized and the water ends up being present in a liquid state. In this case, when the pressure is made into atmospheric pressure and the charging target is vented from the refrigeration cycle in the venting step S30, there is the potential for water to become unable to be included in the charging target and discharged. For this reason, sometimes it becomes difficult to reduce water inside the refrigeration cycle.

With respect thereto, as a method of cleaning the air conditioner 1 of modification (B) of the present invention, the invention may be configured such that, for example, water that is present as an impurity in the refrigeration cycle is changed from a liquid state to a gaseous state by heating and is included in large quantity in the venting target so that water removal in the refrigeration cycle becomes effective.

Specifically, for example, the refrigeration cycle is charged with carbon dioxide such that the temperature of the carbon dioxide with which the refrigeration cycle is charged in the aforementioned charging step S10 becomes a higher temperature state than the boiling point of water that corresponds to the pressure state of the carbon dioxide with which the refrigeration cycle is charged. That is, in the charging step S10, the inside of the refrigeration cycle is pressurized to a pressure that exceeds atmospheric pressure and, in accompaniment therewith, the boiling point of water also rises. For this reason, the aforementioned charging step S10 ends, the boiling point of water that corresponds to the refrigerant pressure inside the refrigeration cycle in the standby step S20 is identified, the refrigerant is heated to a temperature equal to or greater than the boiling point of water that corresponds to this pressure state, and the refrigeration cycle is charged with the refrigerant. Consequently, it becomes easier for water that is present inside the refrigeration cycle to be present in a gaseous state rather than in a liquid state, and the water can be sufficiently mixed together with the carbon dioxide refrigerant with which the refrigeration cycle is charged.

For example, when charging of the refrigeration cycle with carbon dioxide has been performed until the pressure inside the refrigeration cycle that is sensed by the pressure sensor P becomes 0.169 MPa (about 1.7 atm), the boiling point of water becomes 115° C. For this reason, in the charging step S10, the carbon dioxide is heated to a state equal to or greater than 15° C., and the refrigeration cycle is charged with the carbon dioxide. Thus, water that has become water vapor and is present and the carbon dioxide can be sufficiently mixed together.

By performing processing as described above, not only nitrogen but also water can be included in large quantity as impurities in the venting target in the venting step S30. Thus, not only nitrogen but also water can be effectively discharge to the outside from the utilization units 5, the liquid refrigerant pipe 6 and the gas refrigerant pipe 7 of the refrigeration cycle.

Further, here, it suffices for the temperature in the refrigeration cycle to become a temperature equal to or greater than the boiling point of water that corresponds to the pressure condition, so a heater or the like that heats the refrigerant with which the refrigeration cycle is to be charged or heats the refrigeration cycle itself may also be installed.

Because water inside the refrigeration cycle is reduced in this manner, the occurrence of freezing in the refrigeration cycle can be prevented, oxides that arise as a result of the refrigerant pipes and water contacting each other can be reduced, and erosion of the apparatus can be prevented.

(C)

In the air conditioner 1 of the preceding embodiment, there has been taken as an example and described a case where the controller 70 is disposed in the air conditioner 1.

However, the present invention is not limited to this and may also have a configuration where the controller 70 is disposed with respect to the carbon dioxide canister 30, for example. In this case, rather than disposing this controller in the air conditioner 1, effects that are the same as those of the preceding embodiment are obtained by simply preparing the carbon dioxide canister 30 for performing pipe cleaning (D)

In the air conditioner 1 of the preceding embodiment, there has been taken as an example and described a case where the concentration of the nitrogen in the charging target that is vented is measured in the repeating step S40 and where the charging step S10, the standby step S20 and the venting step S30 are repeated until the measured value satisfies an allowable range.

However, the present invention is not limited to this; for example, the invention may also be configured such that, rather than performing processing such as measuring the concentration of the charging target, the control unit 71 determines the number of times that the unit operation of the charging step S10, the standby step S20 and the venting step S30 is to be repeated in accordance with the value of the pressure inside the refrigeration cycle that is set as the pressurization charging of the charging step S10.

It will be noted that, in this case, the invention may be configured such that the pressure inside the refrigeration cycle in the charging processing is different each time. For example, the charging processing may be performed such that the pressure inside the refrigeration cycle becomes higher gradually as the number of times of repetition increases. Further, the invention may be configured such that the control unit 71 determines the pressure condition and the temperature condition in the next charging step S10 in accordance with the concentration of impurities in the charging target that is sensed by the concentration sensor C in each venting step S30. In this case, when the nitrogen concentration inside the refrigeration cycle is high, the quantity of carbon dioxide required for cleaning can be reduced. Further, when the nitrogen concentration inside the refrigeration cycle becomes low as a result of the cleaning processing being repeated, the pressure of the carbon dioxide gas inside the refrigeration cycle is raised even more, whereby discharge of the nitrogen as an impurity can be effectively promoted.

Further, the invention may also be configured such that the number of times of repetition is fixed beforehand by setting input and such that the control unit 71 determines the temperature and the value of the charging pressure in the charging step S10 so as to be able to make the impurity concentration equal to or less than a goal by the number of times of repetition that has been set and inputted.

(E)

In the air conditioner 1 of the preceding embodiment, there has been taken as an example and described the multi type air conditioner 1 where the plural utilization units 5 are connected with respect to the one heat source unit 2.

However, the present invention is not limited to this, and the cleaning method of the preceding embodiment may also be applied using, as a target, a pair type air conditioner where one utilization unit 5 is connected with respect to one heat source unit.

It will be noted that, in the case of this pair type air conditioner, the lengths of the connecting pipes are not enormous, so the air tightness test may be performed after installation.

(F)

In the preceding embodiment, there has been taken as an example and described cleaning processing in a case where nitrogen served as an impurity.

However, the present invention is not limited to this, and the impurity may also be air that includes nitrogen.

(G)

In the cleaning method of the preceding embodiment, there has been taken as an example and described a case where the concentration of an impurity that is present in the venting target that has been vented in the venting step S30 is sensed by the concentration sensor C and where the charging step S10, the standby step S20 and the venting step S30 are repeated by the repeating step S40 until the concentration satisfies the condition of a goal residual concentration.

However, the present invention is not limited to this and may also be configured such that a database indicating the relationship between the number of times that charging and venting are to be repeated, the pressure during charging of the refrigeration cycle and the remaining quantity of the nitrogen that is an impurity inside the refrigeration cycle, such as shown in FIG. 5, is stored in the memory 72.

Additionally, the invention may be configured such that a user inputs a goal residual concentration and a charging pressure in the charging step S10 from the setting input unit 78, whereby the control unit 71 references the chart in FIG. 5 and automatically identifies the number of times of repetition that becomes necessary in the repeating step S40. Here, as shown in FIG. 5, the number of times of repetition that is necessary in order to make the concentration of impurities equal to or less than a predetermined goal is in an inversely proportional relationship with respect to the value of the charging pressure in the charging step S10. Additionally, the control unit 71 may be configured to automatically repeat the charging step S10, the standby step S20 and the venting step S30 the number of times that has been identified.

(H)

In the cleaning method of the preceding embodiment, there has been taken as an example and described a case where the refrigeration cycle is charged with carbon dioxide via the gas pipe service port S7 and where the charging target is vented from the refrigeration cycle via the liquid pipe service port S6.

However, the present invention is not limited to this and may also be configured such that the refrigeration cycle is charged with carbon dioxide via the liquid pipe service port S6 and such that the charging target is vented via the gas pipe service port S7.

Moreover, the invention may also be given a configuration where both charging and venting are performed by only the liquid pipe service port S6 or a configuration where both charging and venting are performed by only the gas pipe service port S7. Thus, cleaning effects are obtained in the same manner as in the preceding embodiment.

INDUSTRIAL APPLICABILITY

By utilizing the present invention, the quantity of impurities remaining in a refrigeration cycle can be reduced while using existing equipment and without having to perform vacuuming, so the present invention is particularly useful as a method of cleaning an air conditioner that uses carbon dioxide as a working refrigerant.

What is claimed is:

1. A method of cleaning an air conditioner, the method comprising:

a nitrogen charging step of charging a refrigeration cycle with nitrogen gas;

a nitrogen venting step of discharging a charging target with which the refrigeration cycle is charged after the nitrogen charging step to the atmosphere;

a nitrogen repeating step of repeating a nitrogen unit operation at least one time, the nitrogen unit operation including the nitrogen charging step and the nitrogen venting step;

a carbon dioxide charging step of charging the refrigeration cycle with carbon dioxide after finishing the nitrogen repeating step;

a carbon dioxide venting step of discharging the charging target with which the refrigeration cycle is charged after the carbon dioxide charging step to the atmosphere;

a carbon dioxide repeating step of repeating a carbon dioxide unit operation at least one time, the carbon dioxide unit operation including the carbon dioxide charging step and the carbon dioxide venting step; and utilizing carbon dioxide as a working refrigerant after finishing the carbon dioxide repeating step;

wherein a relationship between a number of times that the nitrogen unit operation is repeated and at least one of a temperature of the nitrogen with which the refrigeration cycle is charged and a pressure inside the refrigeration cycle when stopping charging is a substantially inverse proportional relationship.

2. The air conditioner cleaning method of claim 1, wherein a relationship between a number of times that the carbon dioxide unit operation is repeated and at least one of a temperature of the carbon dioxide with which the refrigeration cycle is charged and a pressure inside the refrigeration cycle when stopping charging is a substantially inversely proportional relationship.

3. The air conditioner cleaning method of claim 1, wherein at least one of a concentration of a first predetermined component included in a vented charging medium during the nitrogen venting step conducted just before is sensed, with the first determined component being a component other than the nitrogen, at least one of a temperature and a pressure of the nitrogen with which the refrigeration cycle is charged in a subsequent step as the nitrogen charging step after the nitrogen venting step conducted just before is adjusted in accordance with the sensed concentration of the first predetermined component, and a concentration of a second predetermined component included in a vented charging medium during the carbon dioxide venting step conducted just before is sensed, with the second predetermined component being a component other than the carbon dioxide, at least one of a temperature and a pressure of the carbon dioxide with which the refrigeration cycle is charged in a subsequent step as the carbon dioxide charging step after the carbon dioxide venting step conducted just before is adjusted in accordance with the sensed concentration of the second predetermined component.

4. The air conditioner cleaning method of claim 3, wherein at least one of the first predetermined component and the second predetermined component includes water.

5. The air conditioner cleaning method of claim 4, wherein inside of the refrigeration cycle is heated such that a temperature inside the refrigeration cycle exceeds the boiling point of the water that corresponds to the pressure inside the refrigeration cycle.

6. A method of cleaning an air conditioner, the method comprising:

charging a refrigeration cycle with a working fluid, in which a test gas used in an air tightness test remains after the air tightness test as impurity;

discharging a charging target with which the refrigeration cycle is charged after the charging of the refrigeration cycle to the atmosphere;

repeating a unit operation at least one time, the unit operation including the charging of the refrigeration cycle and the venting of the charging target, a relationship between a number of times that the unit operation is repeated and at least one of a temperature of the working fluid with which the refrigeration cycle is charged and a pressure inside the refrigeration cycle when stopping charging being a substantially inversely proportional relationship; and utilizing carbon dioxide as a working refrigerant after finishing the repeating a unit operation.

7. The air conditioner cleaning method of claim 6, wherein the test gas is uncondensed gas.

8. The air conditioner cleaning method of claim 6, wherein the working fluid is carbon dioxide.

9. The air conditioner cleaning method of claim 8, wherein the charging of the refrigeration cycle with the working fluid is performed until a pressure inside the refrigeration cycle at least exceeds atmospheric pressure, and the venting of the charging target is performed until the pressure inside the refrigeration cycle becomes substantially atmospheric pressure.

10. The air conditioner cleaning method of claim 6, wherein the working fluid is nitrogen.

11. The air conditioner cleaning method of claim 6, wherein a concentration of a predetermined component included in a vented charging medium is sensed during the charging of the refrigeration cycle conducted just before, with the predetermined component being a component other than the working fluid, and at least one of a temperature and a pressure of the working fluid with which the refrigeration cycle is charged in a subsequent step as the charging of the refrigeration cycle after the venting of the charging target conducted just before is adjusted in accordance with the sensed concentration of the predetermined component.

12. The air conditioner cleaning method of claim 11, wherein the predetermined component includes water, and inside of the refrigeration cycle is heated such that a temperature inside the refrigeration cycle exceeds the boiling point of the water that corresponds to the pressure inside the refrigeration cycle.

13. The air conditioner cleaning method of claim 6, wherein the refrigeration cycle includes one heat source unit, plural utilization units, and communication pipes in which branching portions are disposed in order to connect the plural utilization units in parallel with respect to the one heat source unit, and the charging of the refrigeration cycle, the venting of the charging target and the repeating of the unit operation are performed using at least the branching portions as a target.

14. An air conditioner using carbon dioxide as a working refrigerant, the air conditioner comprising:

a refrigeration cycle configured to perform a unit operation at least one time, the unit operation including charging a refrigeration cycle with a working fluid and venting discharging a charging target after the charging of the refrigeration cycle to the atmosphere;

a counter configured to count and output the number of times that the unit operation has been performed; and a judging unit configured to determine whether or not to repeat the unit operation based on the number of times outputted by the counter, the judging unit and the refrigeration cycle being further configured such that the unit operation is repeated a number of times that depends on at least one of a temperature of the working fluid with which the refrigeration cycle is charged and a pressure inside the refrigeration cycle after being charged with the working fluid.

15. The air conditioner of claim 14, further comprising a sensing unit configured to sense a concentration of a predetermined component in a vented charging medium, with the predetermined component being a component other than the working fluid, the judging unit and the refrigeration cycle being further configured such that the unit operation is repeated a number of times that corresponds to the concentration of the predetermined component sensed by the sensing unit.

16. The air conditioner of claim 14, further comprising a control unit configured to perform charging and venting control in order to perform charging of the refrigeration cycle with the working fluid and venting of the charging target from the refrigeration cycle after the charging of the refrigeration cycle, the control unit being further configured to stop the charging and venting control when the judging unit determines not to repeat the unit operation.

17. The air conditioner of claim 14, wherein the refrigeration cycle includes one heat source unit, plural utilization units, and communication pipes in which branching portions are disposed in order to connect the plural utilization units in parallel with respect to the one heat source unit, and the unit operation of charging the refrigeration cycle with the working fluid and the venting the charging target after the charging of the refrigeration cycle is performed at least one time using at least the branching portions as a target.

18. The air conditioner cleaning method of claim 14, wherein the working fluid is carbon dioxide.

19. The air conditioner cleaning method of claim 14, wherein the working fluid is nitrogen.

* * * * *